US005490711A

United States Patent [19]

Pollock

[11] Patent Number: 5,490,711

[45] Date of Patent: Feb. 13, 1996

[54] MUSICAL ROCKING CHAIR

[76] Inventor: Alexander Pollock, 16179 Bentler Ave., Detroit, Mich. 48219

[21] Appl. No.: 358,874

[22] Filed: Dec. 19, 1994

[51] Int. Cl.[6] ..... A47C 31/00; A47C 7/72; A63H 5/00

[52] U.S. Cl. ..... 297/186; 297/217.1; 297/188.08; 297/258.1; 446/81; 446/188; 446/396; 84/330

[58] Field of Search ..... 297/186, 217.1, 297/217.4, 188.08, 258, 180.16; 84/330; 446/81, 188, 396

[56] References Cited

U.S. PATENT DOCUMENTS

| | | | |
|---|---|---|---|
| Re. 33,933 | 5/1992 | Hou . | |
| 44,814 | 10/1864 | Neumeyer . | |
| 580,284 | 4/1897 | Krieg | 297/180.16 |
| 1,604,551 | 10/1926 | Cesare | 446/396 |
| 1,749,081 | 3/1930 | Marx | 446/396 |
| 2,664,241 | 12/1953 | Sunday . | |
| 3,204,511 | 9/1965 | Winch . | |
| 4,191,370 | 3/1980 | Meyer et al. . | |
| 4,271,744 | 6/1981 | Kulesza . | |
| 5,143,055 | 9/1992 | Eakin | 297/214.4 |

FOREIGN PATENT DOCUMENTS 392607 12/1908 France .

71981 of 1893 Germany .

*Primary Examiner*—Peter M. Cuomo
*Assistant Examiner*—Anthony D. Barfield
*Attorney, Agent, or Firm*—Dykema Gossett PLLC

[57] ABSTRACT

The musical rocking chair has a body support provided with a seat, a pair of sidewalls and a back projecting upwardly from the seat. The sidewalls of the base are spaced apart to provide with the seat a cavity within the body support. The sidewalls have ground engaging surfaces to permit the body support to rock back and forth when manipulated by a person occupying the seat. A concertina musical instrument is located within the cavity and includes a pair of keyboard operated music boxes and a bellows system for supplying air to the music boxes when the body support is rocked forwards and backwards. A movable bellows actuating plate is engageable with the ground. The actuating plate has one end pivotally carried by the sidewalls, with the other end being provided with one or more rollers so that when the chair is rocked forwards and backwards, the bellows actuating plate also moves resulting in the bellows being contracted or expanded respectively to thereby direct air to the music boxes to produce musical tones under the control of the keys operated by the person occupying the seat.

20 Claims, 2 Drawing Sheets

MUSICAL ROCKING CHAIR

BACKGROUND OF THE INVENTION

I. Field of the Invention

The present invention relates to a musical rocking chair which is adapted to be used by children or adults to provide fun and excitement as well as to obtain an appreciation for music. In addition, the musical rocking chair, will provide exercise for the person setting and rocking in the chair while playing the concertina musical instrument located within the interior of the chair.

II. Description of the Prior Art

It is desirable that in toys intended to be used by young children, that the toys include sound and action, for such a toy attracts a child's attention and provides long periods of entertainment. A sound producing toy, however, should preferably produce more than one sound since only one sound can rapidly become monotonous to the child.

U.S. Pat. No. 4,271,744 entitled "Musical Toy" issued on Jun. 9, 1981, to Ralph J. Kulesza and discloses a housing which includes a bellows for creating a flow of air in an air tube connecting the bellows to a musical instrument such as a harmonica or a plurality of whistles. The musical instrument is selectively moved relative to the outlet of the air tube to create a pattern of different tones or sounds. However, the toy does not include a chair upon which a person would sit when rocking the chair and operating the keyboards of the concertina musical instrument.

Another prior art patent is No. 4,191,370 entitled "Pneumatic Exercising Device" which issued on Mar. 4, 1980, to Burton C. Meyer et al. The exercising device includes a toy seat which comprises a base with a seat mounted for movement between different levels above the base and a fluid chamber in the forms of a bellows supports the seat on the base to move up and down. A hand pump is provided for supplying pressurized fluid to expand the fluid chamber to raise the seat to a level wherein suddenly the pressurized fluid in the chamber may be released to the atmosphere and the seat then settles downwardly until the pressurized fluid is again supplied to the chamber by manual operation of the pump. The exercising device includes a whistle which is associated with an exhaust or release valve so that a whistling sound is produced when pressurized fluid from the seat supporting chamber is released. However, while such a device does disclose a seat and a bellows, no keyboards are provided which a person could operate when rocking the chair.

SUMMARY OF THE PRESENT INVENTION

It is a feature of the present invention to provide a musical rocking chair which is fun and exciting for a child or adult to use and which provides means for exercising the fingers when playing the keyboard operated music boxes while simultaneously exercising the legs when rocking the chair.

Another feature of the present invention is to provide a musical rocking chair that provides for the rendition of a plurality of tones and sounds when the keyboards are actuated by the user when rocking the chair.

Still another feature of the present invention is to provide a musical rocking chair that requires action by the user of the chair to create musical tones as well as a further action by the user to provide a variety or pattern of musical tones when rocking the chair.

Thus it is a feature of the present invention to provide a musical rocking chair comprising a body support having a base provided with a seat, left and right sidewalls and a back projecting upwardly from the seat. The base is provided with a bottom having a curved surface to permit the support to rock when manipulated by a person occupying the seat. The sidewalls of the base are spaced apart to provide a cavity beneath the seat. A musical instrument including a pair of music boxes with keyboards, speakers and a bellows are carried by the body support with the bellows and music boxes located within the cavity of the body support. The keyboards and speakers are located in openings in the sidewalls of the body support to permit the user of the chair when rocking to simultaneously operate the keyboards. An actuating plate is provided below the bellows, with the actuating plate being responsive to the rocking of the chair to compress or expand the bellows and to thereby direct air to a series of tuned reeds and speakers which are controlled by the keys of the keyboards.

A final feature of the present invention is to provide a musical rocking chair of the aforementioned type in which a spring is interposed in the interior of the bellows between the chair structure and the actuating plate for keeping the bellows taut.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
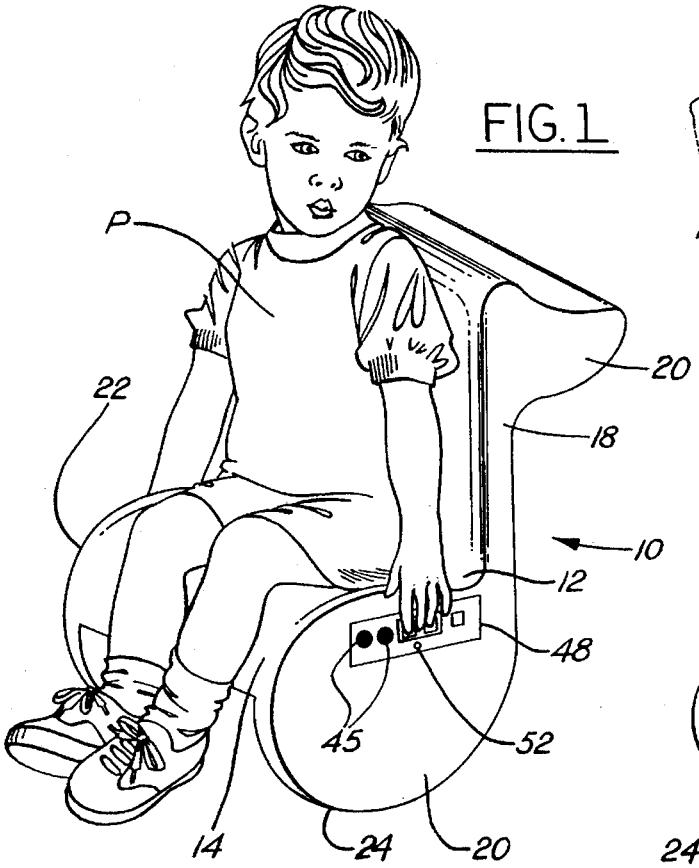
FIG. 1 is a perspective view showing a child sitting in the musical rocking chair and having the child's left hand operating a harmonic keyboard of one of the music boxes incorporated within the interior of the chair.

Referring now to the drawings, there is shown a musical rocking chair 10 having a body support 12 having a base 14 provided with a seat 16 which is contoured. A back 18 extends upwardly from the seat 16 and terminates in an enlargement 20. The base 14 further includes a pair of spaced apart sidewalls 20 and 22 which are provided with ground engaging surfaces 24 and 26 respectively. The ground engaging surfaces 24 and 26 are formed on a radius thereby providing curved or arcuate surfaces which permits the chair 10 to rock forwards and backwards in a rocking motion imparted to the chair by the person P occupying the seat 16.

The chair 10 may be made in various sizes to accommodate children and adults. The body support 12 may be made from a plastic material formed in a mold to provide an integral body support consisting of the chair components previously described. The plastic material may be polyethylene which is vacuum formed in a mold to provide the integral body support. It should be understood, however, that the body support may be made from individual components made from metal, wood or other suitable material which are secured together by fasteners to provide the desired configuration for the chair.

Sidewalls 20 and 22 are spaced apart and define with the seat 16 an internal cavity or interior space 30. In addition, sidewalls 20 and 22 are provided with openings 32 and 34 respectively which permits access to the interior space 30 through the sidewalls.

Figure 5:
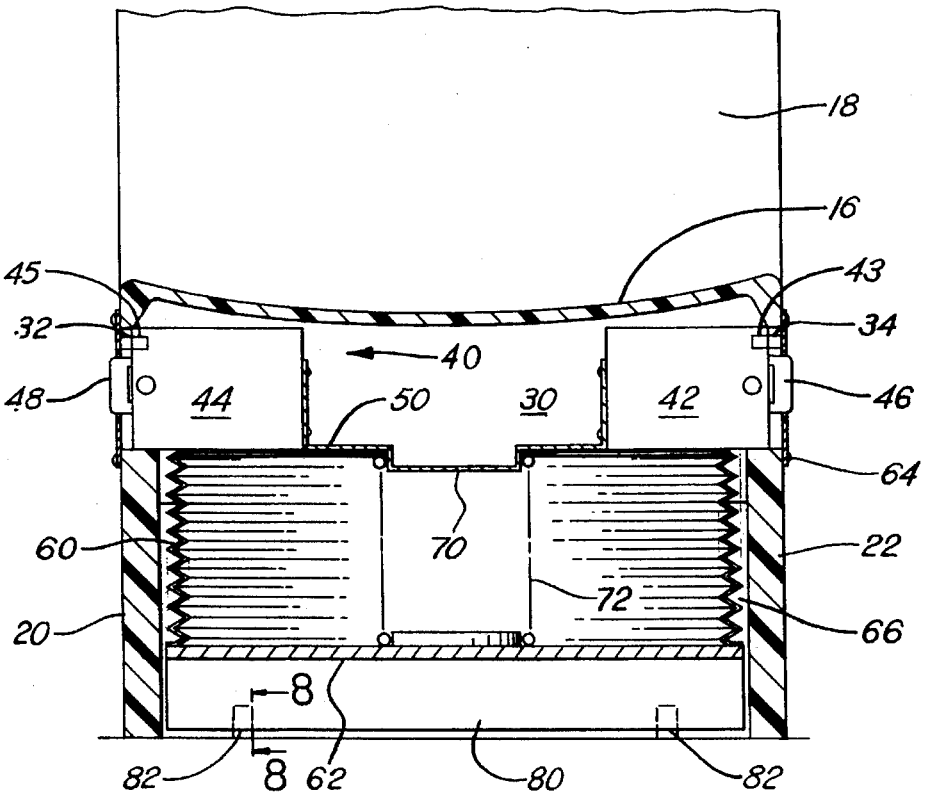
FIG. 5 is a fragmentary sectional view taken on the line 5—5 of FIG. 2.

A concertina musical instrument 40 is located within the cavity 30 and includes a pair of separate keyboard operated music boxes 42 and 44 and corresponding pairs of speakers 43 and 45 respectively. The music boxes 42 and 44 are provided with keyboards 46 and 48 respectively. The keyboards 46 and 48 extend through the sidewalls 22 and 20 respectively to permit the user of the rocking chair to have access to the music boxes 42 and 44. The music boxes 42 and 44 are held in fixed relationship with respect to the sidewalls 22 and 20 respectively by a support means or bracket 50 (FIG. 5) which fixedly mounts the music boxes 42 and 44 adjacent to the sidewalls 22 and 20 respectively as shown in FIG. 5.

Music box 42 includes a series of tuned reeds, each reed having a key mounted in the keyboard 46. Keyboard 46 forms the first keyboard having a treble musical scale provided with seven keys 47 which are adapted to be manipulated by the fingers provided on the right hand of a person P sitting in the chair 10.

Figure 3A:
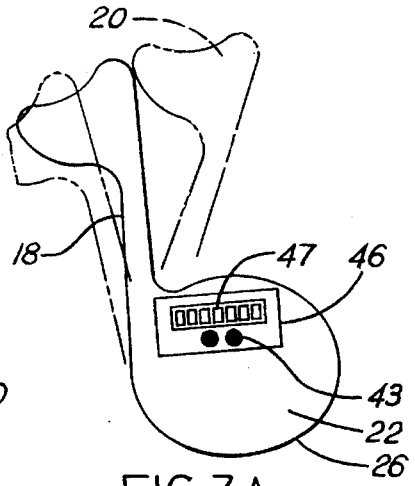
FIG. 3A is a right hand side view of the musical rocking chair showing the external keyboard having a diatonic music scale with seven keys and with the chair shown in several rocking positions represented by dotted lines which result from a rocking motion imported to the chair.
Figure 3B:
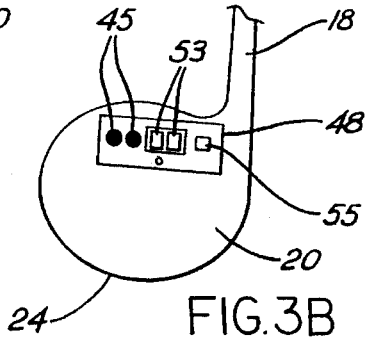
FIG. 3B is a fragmentary view of the left hand side of the musical rocking chair showing an external keyboard having a harmonic function with two keys and an air vent key.
Figure 2:
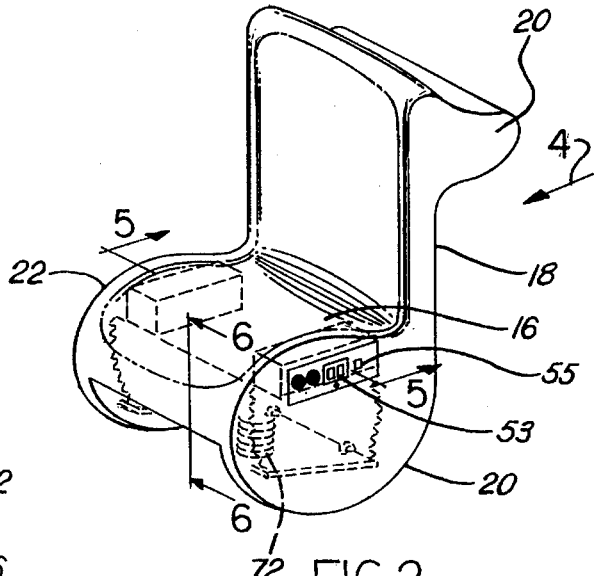
FIG. 2 is a perspective view of the musical rocking chair, with the music boxes, bellows and spring shown in dotted lines.

The second music box 44 includes the bars keyboard 48 which is provided with a plurality or pair of tuned reeds and an air valve 52. The second bass keyboard has a harmonic side provided with the three keys and is located on the left hand side of the chair so as to be actuatable by the fingers provided on the left hand of the person occupying the seat. The three keys (FIGS. 2 and 3B) has a pair of bass keys 53 and an air venting key 55 for opening and closing the air valve 52.

In order to provide air to the tuned reeds of the music boxes 42 and 44 it is necessary to provide an air flow system to the reeds so that when the person occupying the chair actuates the keys, musical tones will result. The air flow system includes a bellows 60 and a bellows actuating plate 62. The bellows is located in the cavity 30 below the music boxes 42 and 44 whereby when the bellow is expanded or contracted air is directed to the appropriate music box under the control of the keys of the keyboards 46 and 48. The bellows 60 may be made from a plastic material, as an example, polyethylene. The bellows has an upper end 64 which is generally closed. The lower end 66 of the bellows 60 is fixedly connected to the bellows actuating plate 62.

The musical tones referred to previously result from air being emitted by the bellows 60 as the air flows through the pre-tuned metal reeds which are activated by pressing of the keys 47, 53 and 55 on the keyboards. The air exiting from the bellows 60 passes through the selected key button reed with sound being heard through the speakers 43 and 45 located adjacent to the keys.

The support means or bracket 50 has a center pilot 70 which provides a seat for a metal spring 72 located within the interior of the bellows 60. The spring 72 has one end guided on the pilot 70, with the other end abutting the actuating plate 62. The purpose of the spring 70 is to hold the bellows 60 taut.

Figure 4:
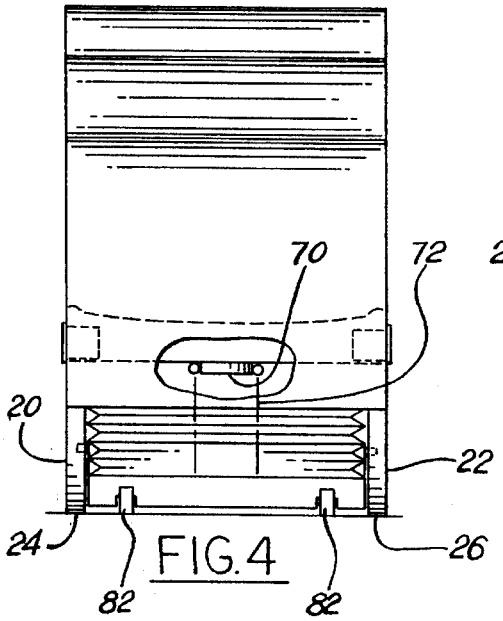
FIG. 4 is a back view of the musical rocking chair looking in the direction of arrow 4 of FIG. 2.
Figure 7:
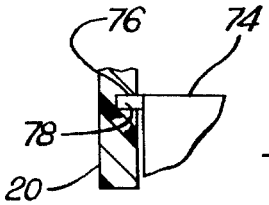
FIG. 7 is a view taken on the line 7—7 of FIG. 6 and showing the manner in which the bellows actuating plate is hingedly carried by the base.
Figure 8:
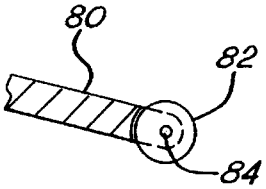
FIG. 8 is a view at the other end of the bellows actuating plate taken on the line 8—8 of FIG. 6.

The bellows actuating plate 62 has one end 74 provided with a pair of laterally extending trunions or stub shafts 76 which are received in recesses 78 provided in the inner surfaces of the opposing sidewalls 20 and 22 as best shown in FIG. 7. The lower end 80 of the bellows actuating plate 62 is provided with a pair of rollers 82 which are spaced apart as best shown in FIGS. 4 and 5. Each roller 82 is appropriately carried by a shaft 84 carried by the actuating plate 62. As an alternative, one long roller could replace the pair of rollers 82 and be rotatably mounted on the lower end of the bellows actuating plate 62.

Figure 6:
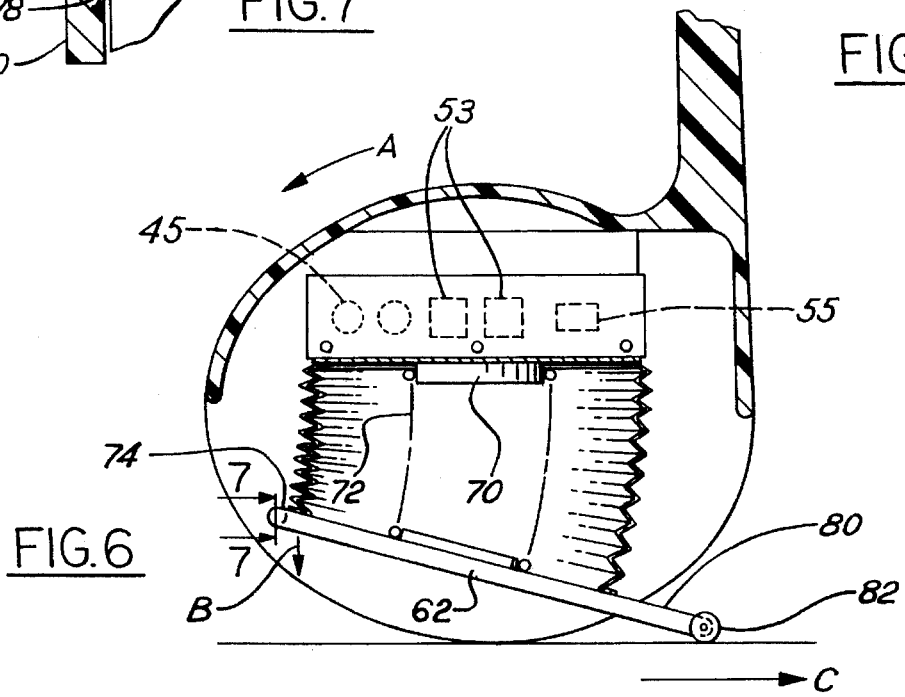
FIG. 6 is a fragmentary sectional view taken on the line 6—6 of FIG. 2 and illustrating the interior of the chair and the relationship between the coil spring, bellows and the movable bellows actuating plate.

It will be appreciated that when a person occupies the seat 16 and uses his or her legs to rock the chair 10 that a forward and rearward rocking motion will result in the contraction and expansion of the bellows 60 respectively. As shown in FIG. 6, when the chair 10 rocks forwardly in the direction of arrow A, the forward end of the bellows actuating plate 62 will move downwardly in the direction of arrow B compressing the bellows 60. This results in the rollers 82 moving rearwardly in the direction of arrow C thereby expanding the bellows 60. The air from the interior of the bellows 60 is directed to the tuned reeds of one or both of the music boxes 42 and 44 as selectively determined by the person P operating the keys 47, 53 and 55 of the keyboards 46 and 48, with the sound being heard through the speakers 43 and 45 positioned adjacent to the reeds or keyboards 46 and 48 of both music boxes 42 and 44.

The concertina musical instrument 40 including the music boxes 42 and 44, keyboards 46 and 48 and the bellows 60 are normally associated together in the form of an accordion. In such a case, the person uses his or her hands to compress and expand the bellows of the accordion to provide air to the music boxes. With the present invention, the rocking motion of the chair or body support performs the function normally provided by the hands of the user of the accordion to expand and contract the bellows to provide air to the music boxes. In use, a person sits in the rocking chair 10 and begins rocking, first in the forward direction to expand the bellows 60 and then in the rearward direction to compress the bellows 60. In order to play a tune, accompaniment is achieved by pressing with the left hand the harmonic buttons or keys 53, 55 provided on the keyboard 48. The harmonic side is equipped with three buttons or keys, one key 55 of which produces no sound but serves to suck in or squeeze out air so that the air can be adjusted during performance. The middle button or key 53 manipulated by the middle finger, is the bass button or key, producing note 1 (dol) when pushing and note 5 (sol) when pulling. The uppermost key is the harmonic button bringing out the cord 1 3 5 (dol, mi, sol) when the bellows are pulled or when the chair is rocked rearwardly and 5 7 2 (sol, si, re) when the bellows is compressed when the chair is rocked forwardly in the direction of arrow A. Thus the keyboards are manipulated by the user just as a person would manipulate an accordion.

What I claim is:

1. A musical rocking chair comprising:

a body support having a base provided with a seat, a pair of sidewalls and a back projecting upwardly from said seat, the sidewalls of said base being spaced apart to provide a cavity within said body support which is located beneath said seat, said sidewalls of said base having ground engaging curved surfaces to permit said body support to rock back and forth when manipulated by a person occupying said seat, said sidewalls having openings therein communicating with said cavity;

a concertina musical instrument located within said cavity, said instrument including a pair of separate keyboard operated music boxes, support means mounting said music boxes within said cavity along said sidewalls, one of said keyboard music boxes having a first keyboard having a plurality of keys with speakers and mounted within the opening in one of said sidewalls, the other of said keyboard music boxes having a second keyboard provided with a plurality of keys with speakers and mounted within the opening in the other of said sidewalls;

said concertina musical instrument including an expandable bellows located within said cavity for providing compressed air and directing the air to said music boxes, a movable bellows actuating plate located in said base and engageable with the ground, said actuating plate having one end pivotally carried by said sidewalls, means connecting said bellows to said plate, said plate being adapted to be responsive to the rocking of said body support by a person occupying said seat to compress or expand said bellows and to thereby direct air to said music boxes to produce musical tones as heard through the speakers under the control of said keys operable by the person occupying said seat.

2. The musical rocking chair of claim 1, wherein said one music box contains a series of tuned reeds under the control of the corresponding keys of said first keyboard adapted to be selectively manipulated by the person occupying said seat.

3. The musical rocking chair of claim 2, wherein said first keyboard has seven keys providing a treble musical scale.

4. The musical rocking chair of claim 3, wherein said first keyboard with the seven treble keys is located on the right hand side of said body support and said second harmonic keyboard is located on the left hand side of said body support.

5. The musical rocking chair of claim 2, wherein said other music box contains a plurality of tuned reeds under the control of the corresponding keys of said second keyboard.

6. The musical rocking chair of claim 5, wherein said second keyboard has three keys comprising two bass keys and one air venting key to provide the harmonic music for the concertina musical instrument.

7. The musical rocking chair of claim 6, wherein an air vent is provided adjacent to the keys of said second keyboard.

8. The musical rocking chair of claim 1, wherein a spring is located in the interior of said bellows between said support means and said movable bellows actuating plate for keeping said bellows taut.

9. The musical rocking chair of claim 8, wherein said support means includes a centrally located support bracket within the interior of said body support for maintaining said music boxes in a fixed position and for providing a seat for piloting one end of said spring.

10. The musical rocking chair of claim 1, wherein said body support is made from a plastic material.

11. The musical rocking chair of claim 10, wherein said plastic material is polyethylene.

12. The musical rocking chair of claim 1, where upon the body support is rocked forwardly, the bellows is expanded and when the body support is rocked rearwardly, the bellows is compressed.

13. A musical rocking chair comprising:

a body support having a base provided with a seat, a pair of sidewalls and a back projecting upwardly from said seat, the sidewalls of said base being spaced apart to provide a hollow interior within said body support beneath said seat, said sidewalls of said base having ground engaging curved surfaces to permit said body support to rock back and forth when manipulated by a person occupying said seat, said sidewalls having openings therein communicating with the interior of said base;

a concertina musical instrument located within the interior of said base, said instrument including a pair of separate keyboard music boxes, support means mounting said music boxes within said hollow interior along said sidewalls, one of said keyboard music boxes having a first keyboard having a plurality of keys with speakers and mounted within the opening in one of said sidewalls, the other of said keyboard music boxes having a second keyboard provided with a plurality of keys with speakers and mounted within the opening in the other of said sidewalls;

said concertina musical instrument including an expandable bellows located within the interior of said base for providing compressed air and directing the air to said keyboard music boxes, a movable bellows actuating plate located in said base and engageable with the ground, said actuating plate having one end pivotally carried by said sidewalls, means connecting said bellows to said plate, said plate being adapted to be responsive to the rocking of said body support by a person occupying said seat to compress or expand said bellows and to direct air to said keyboard music boxes to produce musical tones as heard through the speakers under the control of said keys operable by the person occupying said seat; and a spring located in the interior of said bellows between said support means and said movable actuating plate for keeping said bellows taut.

14. The musical rocking chair of claim 13, wherein said one music box contains a series of tuned reeds under the control of the corresponding keys of said first keyboard which are selectively manipulated by the person occupying said seat.

15. The musical rocking chair of claim 14, wherein said first keyboard has seven keys providing a treble musical scale.

16. The musical rocking chair of claim 14, wherein said other music box contains a plurality of tuned reeds under the control of the corresponding keys of said second keyboard.

17. The musical rocking chair of claim 16, wherein said second keyboard has three keys comprising two bass keys and one air venting key to provide the harmonic music for the concertina musical instrument.

18. The musical rocking chair of claim 17, wherein said first keyboard with the seven treble keys is located on the right hand side of said body support and said second keyboard is located on the left hand side of said body support.

19. The musical rocking chair of claim 13, wherein said support means includes a centrally located support bracket within the interior of said body support for maintaining said music boxes in a fixed position and for providing a seat for piloting one end of said spring.

20. The musical rocking chair of claim 13, wherein the other end of said actuating plate is provided with roller means which are adapted contact the ground and move along the ground as the rocking motion is directed to the chair by the person occupying said seat.

* * * * *